US006970058B2

(12) United States Patent
Gonella et al.

(10) Patent No.: US 6,970,058 B2
(45) Date of Patent: Nov. 29, 2005

(54) L-C TYPE FILTER MODULE AND HELICAL FILTER MADE UP OF AT LEAST TWO SUCH MODULES

(75) Inventors: Olivier Gonella, Bischwiller (FR); Michel Weiss, Gries (FR); Christian Brevard, Wissembourg (FR)

(73) Assignee: Bruker Biospin S.A., Wissembourg (FR)

( * ) Notice: Subject to any disclaimer, the term of this patent is extended or adjusted under 35 U.S.C. 154(b) by 224 days.

(21) Appl. No.: 10/348,898

(22) Filed: Jan. 23, 2003

(65) Prior Publication Data

US 2003/0137369 A1 Jul. 24, 2003

(30) Foreign Application Priority Data

Jan. 23, 2002 (FR) ..... 02 00831

(51) Int. Cl.[7] ..... H01P 1/20
(52) U.S. Cl. ..... 333/202; 333/219; 333/207; 333/226
(58) Field of Search ..... 333/202, 219, 333/207, 226, 222, 203, 202 HC

(56) References Cited

U.S. PATENT DOCUMENTS 2,753,530 A * 7/1956 Horvath ..... 333/202
2,913,681 A 11/1959 Lyman
3,621,484 A * 11/1971 Shult ..... 333/202
3,733,608 A * 5/1973 McGhay et al. ..... 370/339
3,836,881 A * 9/1974 Koizumi ..... 336/87
4,182,997 A * 1/1980 Brambilla ..... 333/175
4,374,370 A * 2/1983 Popovski et al. ..... 333/202
4,385,279 A * 5/1983 Meador ..... 333/235
6,407,651 B1 * 6/2002 Wulff et al. ..... 333/224
2003/0137300 A1 * 7/2003 Gonella et al. ..... 324/322

FOREIGN PATENT DOCUMENTS

FR 1439858 4/1966

* cited by examiner

*Primary Examiner*—Robert Pascal
*Assistant Examiner*—Kimberly E. Glenn
(74) *Attorney, Agent, or Firm*—Young & Thompson

(57) ABSTRACT

An L-C type filter module comprising at least two capacitors and at least one inductor. Each of the capacitors consists of a first elongated element made of conductive material partially fitted in a hole made in a second element made of conductive material, connected electrically to the second elements of the other capacitor(s) or possibly common to the various capacitors, at least the internal lateral surfaces defining the holes being covered with dielectric material, as are the edges of the openings of the holes or perforations and at least parts, or preferably all, of the external surfaces of the second element(s) adjoining the edges, and the coil of each inductor is carried by a support body made of dielectric material, possibly contiguous with the second element(s) or the dielectric coating at least partially covering the external face of each second element.

20 Claims, 4 Drawing Sheets

L-C TYPE FILTER MODULE AND HELICAL FILTER MADE UP OF AT LEAST TWO SUCH MODULES

BACKGROUND OF THE INVENTION

The present invention concerns the field of passive electrical components or circuits, more particularly the filters formed by the association of capacitors and inductors, and relates to a filter module composed of such components and a helical filter, in particular a band-pass filter, comprising at least two such modules.

DESCRIPTION OF THE RELATED ART

In certain applications, in particular in connection with nuclear magnetic resonance (NMR), it is necessary to have components suitable for the high frequencies that can support high power. It is of course advantageous that such components should if necessary be easily adjustable, easy to manufacture, have a low manufacturing cost, and demonstrate good resistance to ageing.

Thus, with regard to capacitors, a variable or adjustable capacitor structure has been proposed comprising substantially, on the one hand, a first element made of conductive material in the form of an at least partially hollow rod or bar, comprising a hole or perforation extending axially in the body of said first element to form a portion of tube and, on the other hand, a second element also made of conductive material in the form of a rod that can be fitted over a variable depth in said axial hole, the engagement depth of the second element in the first element determining the degree of capacitive coupling between them, and therefore the value of the resulting capacitor.

These capacitors are used in particular to produce high frequency filters.

Although such a capacitor construction may withstand large dynamic currents, its voltage resistance is not sufficient in certain applications, or does not provide a sufficient safety guarantee against arcing risks in the event of excess voltage.

Moreover, it is also advantageous, in many cases, to combine several capacitive components with one or more inductive components, both of which have high power limits, in compact filtering modules, that are easy to manufacture and assemble in variable numbers, with a low manufacturing cost and very good filtering properties.

SUMMARY OF THE INVENTION

The object of the present invention is, in particular, to meet at least some of the needs expressed above and to reduce at least some of the above-mentioned drawbacks.

To this end, the present invention relates to an L-C type filter module comprising at least two capacitors and at least one inductor, characterised in that each capacitor consists of a first elongated element made of conductive material partially fitted, over a determined depth, in a hole or perforation made in a second element made of conductive material, connected electrically to the second elements of the other capacitor(s) or possibly common to the various capacitors, at least the internal lateral surfaces defining said holes or perforations being covered with dielectric material, as are the edges of the openings of the holes or perforations and at least parts, and preferably all, of the external surfaces of the second element(s) adjoining said edges, and in that the coil of each inductor is carried by a support body made of dielectric material, possibly contiguous with the second element(s) or with the dielectric coating at least partially covering the external face of each second element.

A further object of the invention is to provide a helical band-pass filter which has in particular better filtering of harmonics.

To this end, the present invention also relates to a helical filter of at least the order 2 with a modular structure, characterised in that it is formed by the series connection of at least two filter modules of the above-mentioned type, each with specific filtering characteristics that can be adjusted by regulating the characteristics of at least one capacitor, each of the various modules being housed in a corresponding electromagnetically insulated compartment of a box forming a Faraday cage.

BRIEF DESCRIPTION OF THE DRAWINGS

The invention will be better understood using the description below, which relates to preferred embodiments, given as non-restrictive examples, and explained with reference to the accompanying diagrammatic drawings, in which.

DESCRIPTION OF THE PREFERRED EMBODIMENTS

Figure 1:
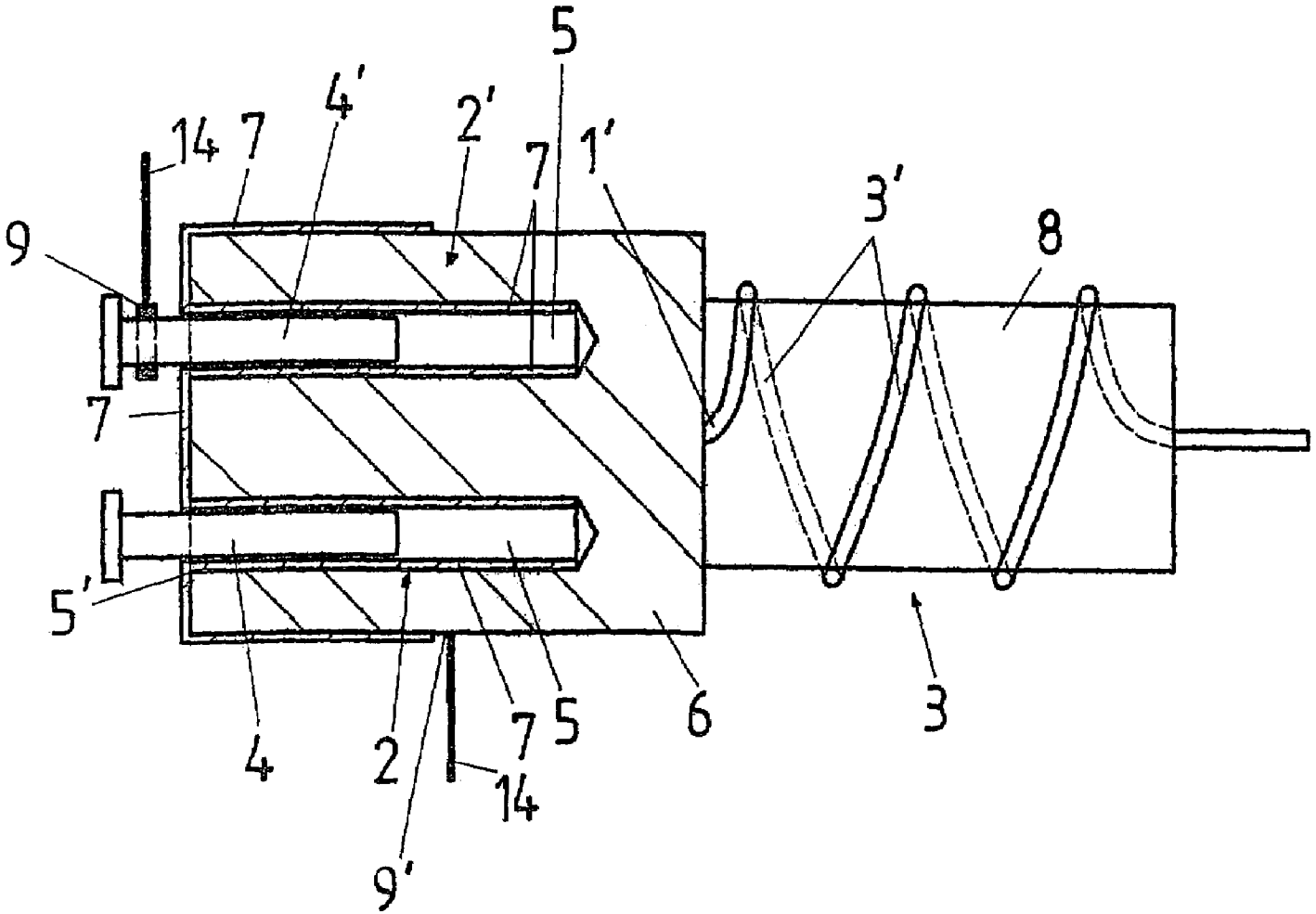
FIG. 1 is a diagrammatic illustration, partly in section, of a filter module according to a first embodiment of the invention.
Figure 4:
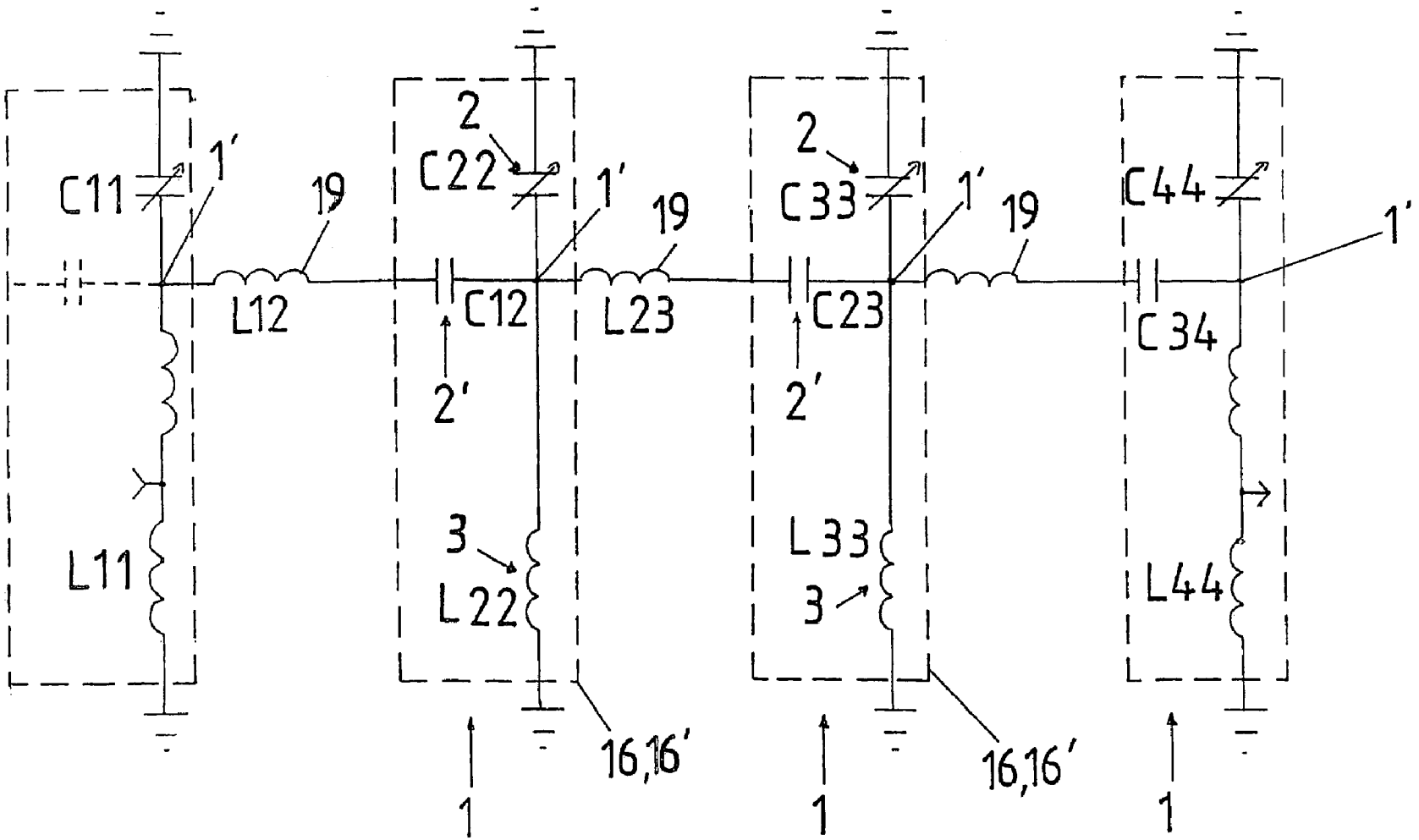
FIG. 4 is an equivalent electrical diagram of the filter illustrated in FIGS. 2 and 3.

As is shown in particular in FIGS. 1 and 4 of the accompanying drawings, the filter module 1 comprises at least two capacitors 2, 2' and at least one inductor 3.

Figure 2:
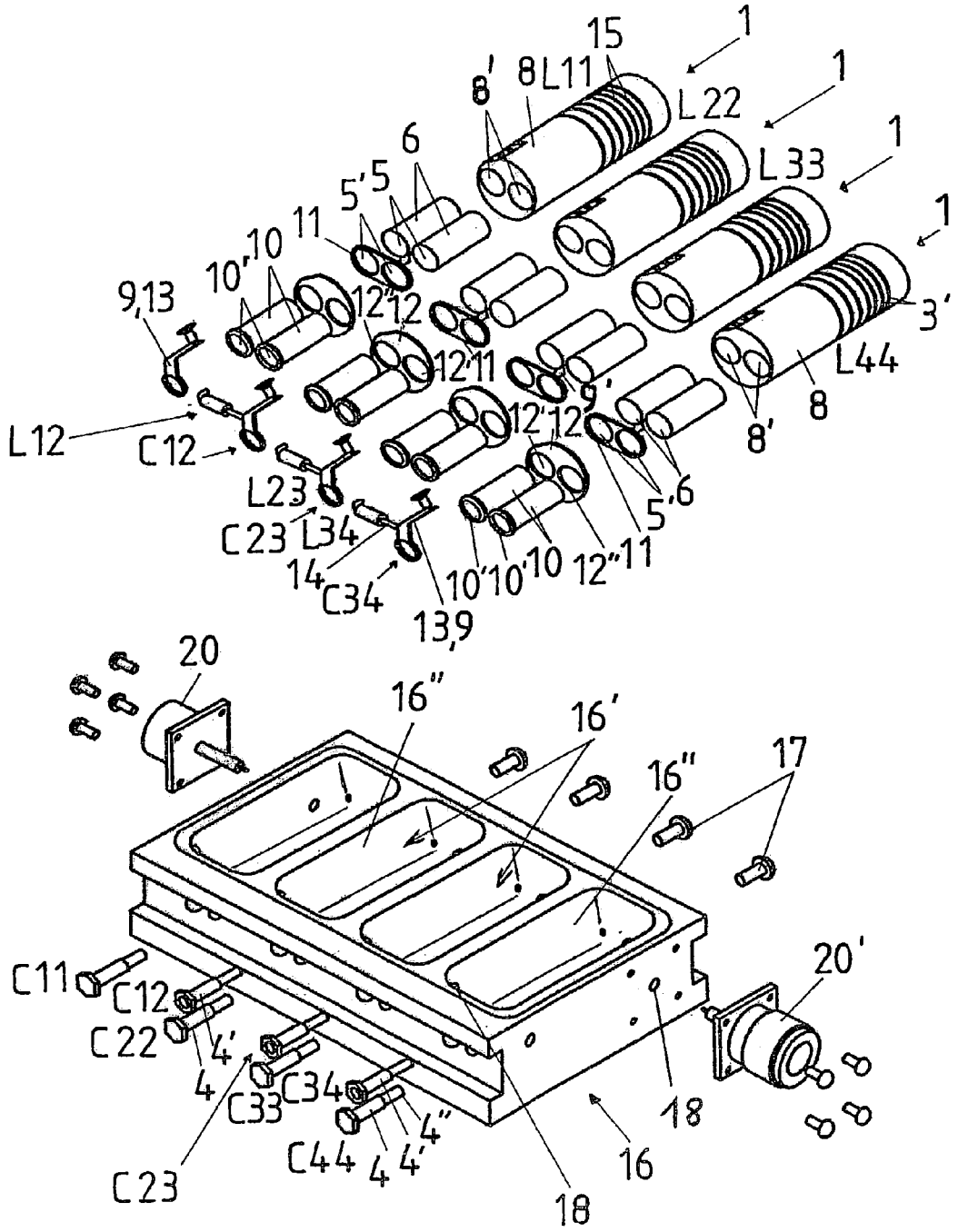
FIG. 2 is an exploded view in perspective of a helical filter composed of four filter modules connected in series, according to a second embodiment of the invention.
Figure 3:
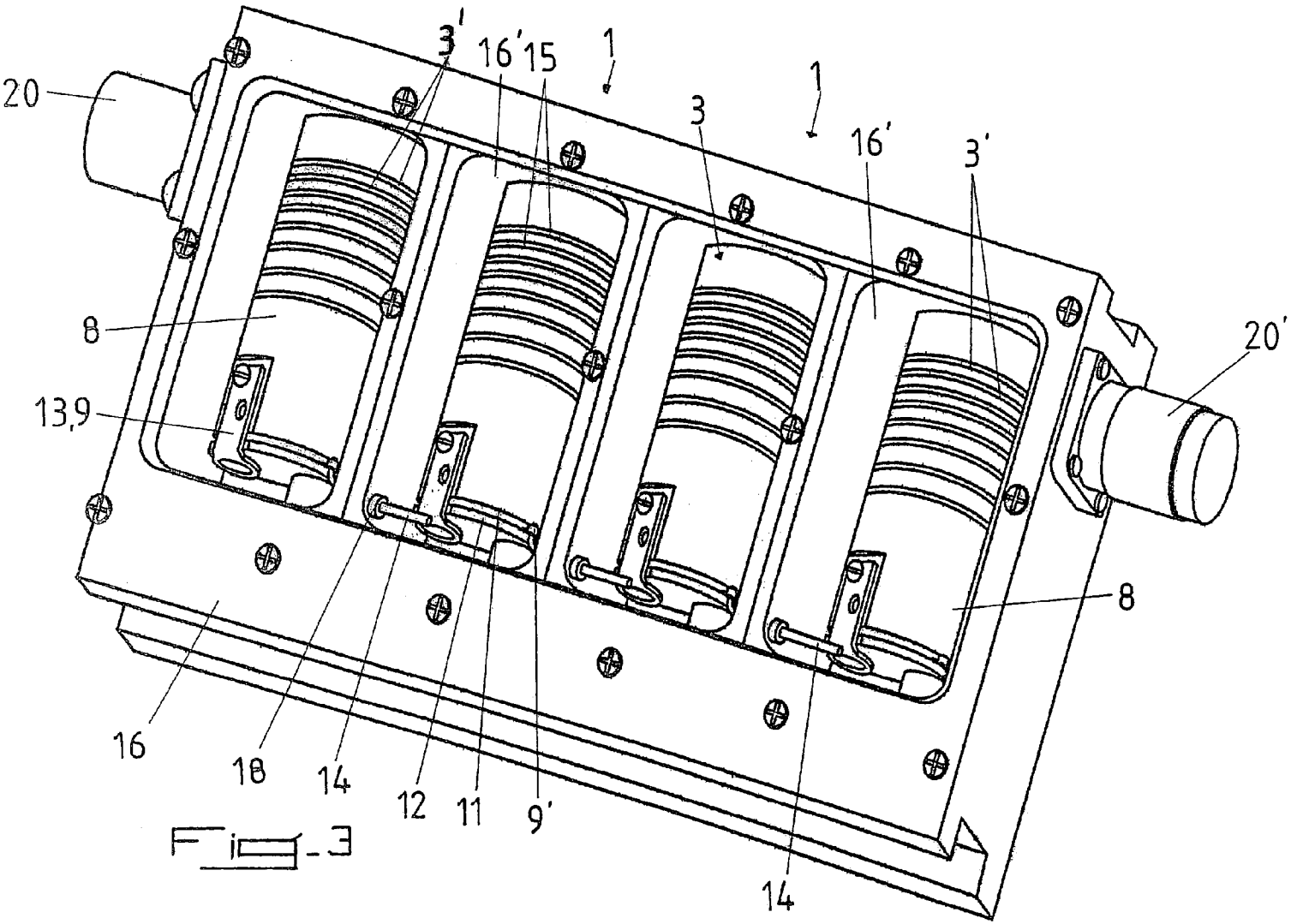
FIG. 3 is a view from above in perspective of the filter in FIG. 2 in the assembled state (the closing cover of the box being removed)

In accordance with the invention, each of the capacitors 2, 2' consists of a first elongated element 4; 4' made of conductive material partially fitted, over a determined depth, in a hole or perforation 5 made in a second element 6 made of conductive material, connected electrically to the second elements of the other capacitor(s) or possibly common to the various capacitors 2, 2', at least the internal lateral surfaces defining said holes or perforations 5 being covered with a dielectric material 7, as are the edges 5' of the openings of the holes or perforations 5 and at least parts, and preferably all, of the external surfaces of the second element(s) 6 adjoining said edges 5', and in that the coil 3' of each inductor is carried by a support body 8 made of dielectric material, possibly contiguous with the second element(s) 6 or with the dielectric coating 7 at least partially covering the external face of each second element 6 (FIGS. 1 to 3).

The above-mentioned arrangements in particular allow improved voltage resistance to be obtained, very good protection of the capacitors against the risk of arcing (between the first and second element(s)) and if necessary a very compact structure.

With a view to allowing the properties of the filter module 1 to be adjusted, at least one 2 of the capacitors 2, 2' is produced in the form of a variable capacitor, its first elongated element 4 consisting of a screw or similar with an end portion 4", opposite its head, that has no thread and can slide, advantageously with sliding contact, in the hole or perforation 5 of the corresponding second element 3, another 4' of said first unit elements 2 of said capacitors 2, 2', that is preferably non-sliding, and the or one of the second element(s) 6 forming, since they are each integral or load-bearing, one of the two branch terminals 9, 9' of said filter module 1.

A possible variable capacitor structure 2 is described in particular in French Patent Application No. 02 00770 of 22 Jan. 2002 in the name of the applicant, the content of which is incorporated herein by reference.

According to a preferred embodiment of the invention, illustrated in FIGS. 2 and 3 of the accompanying drawings and resulting in a compact construction, that is easy to assemble and has optimum resistance to shocks and electric arcs, the or each of the second element(s) 6 is installed entirely in the solid support body 8 made of dielectric material carrying the coil 3' of said inductor 3, this solid body 8 thus covering its or their external surface.

Hollow tubes 10 made of dielectric material and provided with a flange 10' at one of their ends are fitted in the holes or perforations 5 of the second element(s) 6, thus covering the internal surfaces of said holes or perforations 5, and the edges 5' of their openings and possibly parts of the external surface adjoining the edges.

As shown in the figures of the accompanying drawings, the various capacitors 2, 2' may either comprise a common second element 6, in a single piece (FIG. 1), or each comprise its own second element 6 distinct from the second elements of the other capacitor(s) (FIGS. 2 to 4).

Similarly, the dielectric material 7 may cover only part or all of the external surface of the second element(s) 6 and be produced either in a single piece, with continuous covering of the side walls of the holes 5, of their edges 5' in the region of the introduction openings of the corresponding first elements 4 and of the alternative external surfaces at said edges, or from several juxtaposed parts, also producing a quasi-continuous coating 7.

In accordance with an advantageous, easy-to-produce variation of the invention, shown in FIGS. 2 and 3 of the accompanying drawings, the second elements 6 each consist of a portion of metal tube inserted, in a close-fitting way, into a corresponding blind hole 8' in the solid support body 8 made of dielectric material, the flush edges 5' of the various portions of tubes 6 being attached, for example by welding or crimping, to a connection plate 11 made of conductive material, making contact on the face of the support body 8 provided with blind reception holes 8' for the second elements 6, said plate 11 being provided with a branch terminal 9' in the form of a prominent lateral lug.

To provide protection against possible arcing between the first elements 4 and the plate 11 forming part of the corresponding second element 6, a plate 12 made of dielectric material covers the conductive connection plate 11 and comprises orifices 12' provided with radial recesses 12" forming ring-shaped seats for the positive reception of the flanges 10' of the hollow tubes 10 fitted in the holes or perforations 5 of the second elements 6 of the capacitors 2, 2'. The plate 12 may for example consist of a cut-off slice of the support body 8.

The assembly of the flanges 10' cooperating with the plate 12 provides a continuous dielectric coating 7 in this area with the creation of a deflector guaranteeing that there is no gap.

As also shown in the figures of the accompanying drawings, the filter module 1 will advantageously comprise an inductor 3 (or L,i,i) and two capacitors 2 (or Ci, i) and 2' (or Ci-1, i) connected to a common electric node 1', at least one 2 of said capacitors 2, 2' being variable or adjustable due to a first element 4 installed with translation capacity in the corresponding second element 6 and the first element 4' of the other optionally non-variable capacitor 2' being attached to a branch terminal 9 in the form of a thin strip 13 fixed on the support body made of dielectric material 8 and to which is attached the end of a connection line 14.

The thin strip 13 may thus serve as a support for the first elongated element 4', which element may also be in the form of a screw or similar.

Preferably, said solid support body 8 has a cylindrical structure and comprises a helical groove 15 extending over at least part of its external surface, for the housing of the coil 3' forming the inductor 3, said support body 8 preferably consisting of polytetrafluoroethylene PTFE (FIGS. 2 and 3).

To achieve good connection and rigid retention of the coil 3', the coil may advantageously be press-fitted in a close-fitting manner in at least a portion of said groove 15.

Such assembly allows the physical, electrical and electromagnetic characteristics of the inductor 3 to be maintained over time, preventing its deformation, by producing a dampening of the vibrations and shocks to which said inductor 3 could be exposed and protecting it from any deformation connected with temperature variations.

To prevent the module 1 from interfering with the surrounding environment, the constituent parts of said capacitors 2, 2' and of said at least one inductor 3 are housed in a closed preferably parallelepiped metal box 16, forming a Faraday cage and are retained therein by fixing to two opposed side walls thereof by means of two screws 4, 17, bolts or similar, a first of said screws forming the first sliding elongated element 4 of a variable capacitor 2 and the second screw 17 making the opposite end of the dielectric support body 8 integral with a corresponding wall of said box 16 and ensuring the return to earth of said at least one inductor, the two connection lines 14 of said module 1 extending through traversing orifices 18, of small size, preferably substantially adapted in dimensions to those of the connection lines 14 which traverse them, these orifices being made in the walls of said box 16.

According to another characteristic of the invention, the coil 3' of the inductor 3, mounted on the support body 8, has a variable pitch, increasing in the direction of the second element(s) 6 of the capacitors 2, 2' or of the edges 5' of the openings of the holes or perforation 5 of said second element(s) 6.

This measure allows the coil 3' to be further protected against arcing or breakdown phenomena from the inductor 3 exposed to the highest voltage.

The present invention also relates to a helical filter of at least the order 2 with a modular structure, characterised in that it is formed by the series connection of at least two filter modules 1 such as those described above, each with specific filtering characteristics that can be adjusted by regulating the characteristics of at least one capacitor 2, the various modules 1 each being housed in a corresponding closed compartment 16' of a box 16 forming a Faraday cage, while being electromagnetically insulated from the exterior and from the other module(s) 1 forming the filter.

Such an embodiment allows the filtering of harmonics to be considerably improved, due to the absence of a magnetic coupling between modules 1 or of modules 1 with the exterior.

Advantageously, the electrical connection between two adjacent modules 1 is made by means of a corresponding line 14 extending through the wall 16" separating said two adjacent modules concerned, through an orifice 18 of which the size is substantially adapted to that of the cross-section of said line 14.

By limiting the parasitic inductance 19 (Ci, i+1) of the connection between modules 1 (particularly due to the connection line 14), a purely capacitive coupling is consequently obtained between the modules 1 (by the capacitors Ci, i+1) allowing the higher harmonics to be eliminated in said filter.

According to a preferred embodiment of the invention, also illustrated in FIGS. 2, 3 and 4, the helical filter is advantageously formed by the series connection of four filter modules 1 according to any one of claims 1 to 7, the conductors of the connection connectors 20, 20' of said filter, mounted on the box 16, being connected to the series connection of filter modules 1 in the region of the inductors 3 of the two end modules 1 of said chain of modules 1 forming said filter.

The capacitor 2' of said first module 1 of the chain forming the filter will then be useless and may be eliminated.

Of course, the invention is not restricted to the embodiments described and illustrated in the accompanying drawings. Modifications are possible, particularly from the point of view of the constitution of the various elements or by substitution of technical equivalents, without departing from the scope of protection of the invention.

What is claimed is:

1. L-C type filter module comprising:

at least two capacitors, at least one inductor (3) with a coil (3'), each of the capacitors (2, 2) comprising an elongated first element (4; 4) made of conductive material partially fitted, over a determined depth, in a hole or perforation (5) made in a second element (6) made of conductive material, connected electrically to the second element of the other capacitor(s) or common to the other capacitors (2, 2), at least the internal lateral surfaces defining said hole or perforation (5) being covered with a dielectric material (7), as are the edges (5) of the openings of the hole or perforation (5) and at least parts of external surfaces of the second element (6) adjoining said edges (5), and a support body (8) carrying the coil (3) of each inductor (3), the support body (8) made of dielectric material, possibly contiguous with the second element (6) or with the dielectric coating (7) at least partially covering the external face of the second element (6).

2. Filter module according to claim 1, wherein, a first capacitor of the at least two capacitors (2, 2) is a variable capacitor, the first capacitor's first element (4) comprises a screw or similar with an end portion (4), opposite its head, that has no thread and can slide, in the hole or perforation (5) of the corresponding second element (3), the first element (4) of a second capacitor of the at least two capacitors is non-sliding, and the second element (6) of one the first capacitor and the second capacitor forming one of two branch terminals (9, 9) of said filter module (1).

3. Filter module according to claim 1, wherein, each second element (6) is installed wholly in the support body (8) carrying the coil (3), said support body being a solid body (8) covering the external surface of the second element, and a hollow tube (10) made of dielectric material and provided with a flange (10) at one end are fitted in the hole or perforation (5) of the second element (6), the hollow tube covering the internal surfaces of said hole or perforation (5), and the edges (5) of the hole opening and possibly parts of the external surface adjoining the edges.

4. Filter module according to claim 1, wherein, each second element (6) comprises a portion of metal tube inserted, in a close-fitting way, into a corresponding blind hole (8) in the support body (8) made of dielectric material, flush edges (5) of the various portions of tube (6) being attached to a connection plate (11) made of conductive material, making contact on the face of the support body (8) provided with blind reception holes (8) for the second element (6), said plate (11) being provided with a branch terminal (9) in the form of a prominent lateral lug.

5. Filter module according to claim 4, wherein, a plate (12) made of dielectric material covers the conductive connection plate (11) and comprises orifices (12) provided with radial recesses (12) forming ring-shaped seats for the positive reception of the flanges (10) of the hollow tubes (10) fitted in the hole or perforation (5) of the second element (6).

6. Filter module according to claim 1, wherein, at least a first capacitor (2) of said capacitors (2, 2) is variable or adjustable due to the first capacitor's first element (4) being installed with translation capacity in the corresponding second element (6), and the first element (4) of another of the capacitors (2) being attached to a branch terminal (9) in the form of a thin strip (13) fixed on the support body made of dielectric material (8) and to which is attached the end of a connection line (14).

7. Filter module according to claim 1, wherein, said support body is a solid support body (8) that has a cylindrical structure and comprises a helical groove (15) extending over at least part of its external surface, for the housing of the coil (3) forming the inductor (3), and said coil (3) is press-fitted in a close-fitting manner in at least a portion of said groove (15).

8. Filter module according to claim 1, wherein, the constituent parts of said capacitors (2, 2) and of said at least one inductor (3) are housed in a closed box (16) forming a Faraday cage and are retained therein by fixing to two opposed side walls thereof by means of two screws (4, 17), bolts or similar, a first of said screws forming the first sliding elongated element (4) of a variable capacitor (2) and the second screw (17) making the opposite end of the dielectric support body (8) integral with a corresponding wall of said box (16) and ensuring the return to earth of said at least one inductor (3), the two connection lines (14) of said module (1) extending through traversing orifices (18) made in the walls of said box (16), of small size, preferably substantially adapted in dimensions to those of the connection lines (14) which traverse them.

9. Filter module according to claim 1, wherein, the coil (3) of the inductor (3), mounted on the support body (8), has a variable pitch, increasing in the direction of the second element (6) or increasing of the edges (5) of the openings of the hole or perforation (5) of said second element (6).

10. Helical filter at least of the order 2 with a modular structure, comprising a series connection of at least two filter modules (1) according to claim 1, each of the filter modules with specific filtering characteristics that can be adjusted by regulating the characteristics of at least one capacitor (2), each of the filter modules (1) being housed in a corresponding closed compartment (16) of a box (16) forming a Faraday cage, while being electromagnetically insulated from the exterior of any other filter module (1) forming the filter.

11. Helical filter according to claim 10, wherein, the electrical connection between two adjacent ones of said filter modules is made by a corresponding line (14) extending through a wall of said box (16) separating said two adjacent modules (1), through an orifice (18) of which the size is substantially adapted to that of the cross-section of said line (14).

12. Helical filter according to claim 10, wherein, four of said filter modules are connected in series as a chain of modules, and a conductors of the connection connectors (20, 20) of said filter, mounted on the box (16), being connected to the series connection of said four filter modules (1) in the region of the inductors (3) of two end modules (1) of said chain of modules (1).

13. L-C type filter module comprising:

an inductor;

at least two capacitors;

a coil (3) for said inductor (3); and a dielectric support body (8) carrying said coil, each of the capacitors (2, 2) comprising a conductive elongated first element (4; 4') and a conductive second element (6), a hole (5) in the second element, a dielectric material (7) covering at least internal lateral surfaces of said hole, edges (5') of an opening of said hole, and external surfaces of said second element adjoining said edges, the first elongated element partially fitted in the hole, wherein, the second element of a first of the capacitors is electrically connected to the second element of a second of the capacitors.

14. Filter module according to claim 13, wherein, the first element, of a first capacitor of said capacitors, is in sliding contact with the hole of the corresponding second element (3), the first element, of a second capacitor of said capacitors, is non-sliding with the hole of the corresponding second element (3), and the second element (6) of one of the first and second capacitors forms a branch terminal (9, 9) of said filter module (1).

15. Filter module according to claim 13, wherein, each second element (6) is installed wholly in the support body (8), the support body (8) covers the external surface of each second element, and hollow tubes (10) made of dielectric material and provided with a flange (10) are fitted in the hole (5) of each second element (6) covering the internal surfaces of said hole (5) and the edges (5) of the hole opening.

16. Filter module according to claim 13, wherein, each second element comprises a portion of metal tube inserted, in close-fitting proximity, into a corresponding blind hole (8) in the support body (8), flush edges (5) of the tube (6) are attached to a conductive connection plate (11) making contact on the face of the support body (8), and said plate (11) is provided with a branch terminal (9) in the form of a lateral lug.

17. Filter module according to claim 15, wherein, a dielectric plate (12) covers the conductive connection plate (11) and comprises orifices (12) provided with radial recesses (12) forming ring-shaped seats.

18. Filter module according to claim 13, wherein, the support body is a solid support body (8) having a cylindrical structure and a helical groove (15) extending over at least part of its external surface.

19. filter module according to claim 18, wherein, said support body (8) comprises polytetrafluoroethylene, and said coil is press-fitted in at least a portion of said groove (15).

20. Filter module according to claim 13, wherein, said at inductor (3) is housed in a closed box (16) forming a Faraday cage, and the coil has a variable pitch.

* * * * *